US009085817B2

(12) United States Patent
Miyazaki et al.

(10) Patent No.: US 9,085,817 B2
(45) Date of Patent: Jul. 21, 2015

(54) NON-ORIENTED ELECTRICAL STEEL SHEET AND MANUFACTURING METHOD THEREOF

(75) Inventors: Masafumi Miyazaki, Tokyo (JP); Hideaki Yamamura, Tokyo (JP); Takeshi Kubota, Tokyo (JP); Yousuke Kurosaki, Tokyo (JP); Kazuto Kawakami, Tokyo (JP); Kazumi Mizukami, Tokyo (JP); Takeaki Wakisaka, Tokyo (JP)

(73) Assignee: NIPPON STEEL & SUMITOMO METAL CORPORATION, Tokyo (JP)

( * ) Notice: Subject to any disclaimer, the term of this patent is extended or adjusted under 35 U.S.C. 154(b) by 636 days.

(21) Appl. No.: 13/258,688

(22) PCT Filed: May 25, 2010

(86) PCT No.: PCT/JP2010/058807

§ 371 (c)(1),
(2), (4) Date: Sep. 22, 2011

(87) PCT Pub. No.: WO2010/140509

PCT Pub. Date: Dec. 9, 2010

(65) Prior Publication Data

US 2012/0014828 A1 Jan. 19, 2012

(30) Foreign Application Priority Data

Jun. 3, 2009 (JP) ..... 2009-134178
Apr. 20, 2010 (JP) ..... 2010-097274

(51) Int. Cl.
*C22C 38/02* (2006.01)
*C22C 38/00* (2006.01)
(Continued)

(52) U.S. Cl.
CPC ..... *C22C 38/02* (2013.01); *B22D 11/00* (2013.01); *B22D 11/108* (2013.01); *C22C 38/00* (2013.01);
(Continued)

(58) Field of Classification Search
CPC ..... C22C 38/00; C22C 38/02; C22C 38/04; C22C 38/06
USPC ..... 148/320, 325, 331, 336, 540; 420/8, 34, 420/40, 103, 118
See application file for complete search history.

(56) References Cited

U.S. PATENT DOCUMENTS 7,470,333 B2 12/2008 Ohashi et al.
7,922,834 B2 4/2011 Tanaka et al.
(Continued)

FOREIGN PATENT DOCUMENTS

CN 1784504 A 6/2006
CN 101218362 A 7/2008
(Continued)

OTHER PUBLICATIONS

International Search Report, dated Aug. 31, 2010, issued in PCT/JP2010/058807.
(Continued)

*Primary Examiner* — Brian Walck
(74) *Attorney, Agent, or Firm* — Birch, Stewart, Kolasch & Birch, LLP

(57) ABSTRACT

In a non-oriented electrical steel sheet, Si: not less than 1.0 mass % nor more than 3.5 mass %, Al: not less than 0.1 mass % nor more than 3.0 mass %, Ti: not less than 0.001 mass % nor more than 0.01 mass %, Bi: not less than 0.001 mass % nor more than 0.01 mass %, and so on are contained. (1) expression described below is satisfied when a Ti content (mass %) is represented as [Ti] and a Bi content (mass %) is represented as [Bi].

$$[Ti] \leq 0.8 \times [Bi] + 0.002 \quad (1)$$

9 Claims, 3 Drawing Sheets

(51) Int. Cl.

| | |
|---|---|
| ***C22C 38/04*** | (2006.01) |
| ***B22D 11/00*** | (2006.01) |
| ***B22D 11/108*** | (2006.01) |
| ***C22C 38/06*** | (2006.01) |
| ***C22C 38/14*** | (2006.01) |
| ***H01F 1/16*** | (2006.01) |

(52) U.S. Cl.
CPC ..... *C22C 38/002* (2013.01); *C22C 38/04* (2013.01); *C22C 38/06* (2013.01); *C22C 38/14* (2013.01); *H01F 1/16* (2013.01)

(56) References Cited

U.S. PATENT DOCUMENTS

| | | | |
|---|---|---|---|
| 8,157,928 | B2 | 4/2012 | Tanaka et al. |
| 2006/0243351 | A1 | 11/2006 | Ohashi et al. |
| 2009/0202383 | A1 | 8/2009 | Tanaka et al. |
| 2009/0250145 | A1 | 10/2009 | Kurosaki et al. |
| 2011/0042625 | A1 | 2/2011 | Tanaka et al. |

FOREIGN PATENT DOCUMENTS

| | | | |
|---|---|---|---|
| EP | 2 031 079 | A1 | 3/2009 |
| JP | 6-88171 | A | 3/1994 |
| JP | 8-188825 | A | 7/1996 |
| JP | 9-316535 | A | 12/1997 |
| JP | 2001-40456 | A | 2/2001 |
| JP | 2002-252107 | A | 9/2002 |
| JP | 2007-16278 | A | 1/2007 |
| JP | 2007-023351 | A | 2/2007 |
| JP | 2007-31755 | A | 2/2007 |
| JP | 2007-162062 | A | 6/2007 |
| JP | 2008-132534 | A | 6/2008 |
| RU | 2163933 | C1 | 3/2001 |
| WO | WO 2007/007423 | A1 | 1/2007 |

OTHER PUBLICATIONS

Chinese Office Action issued Sep. 3, 2013 in corresponding Chinese Patent Application No. 201080024288.6.

Forms PCT/IB/338, PCT/IB/373, and PCT/ISA/237, mailed Jan. 26, 2012, for International Application No. PCT/JP2010/058807.

Russian Office Action issued Mar. 22, 2013 in corresponding Russian Application No. 2011152605.

Extended European Search Report for Patent Application No. 10783293.3, dated Jun. 23, 2014.

NON-ORIENTED ELECTRICAL STEEL SHEET AND MANUFACTURING METHOD THEREOF

TECHNICAL FIELD

The present invention relates to a non-oriented electrical steel sheet suitable for an iron core of a motor or the like and a manufacturing method thereof.

BACKGROUND ART

In recent years, in terms of prevention of global warming and the like, a further reduction in power consumption in a motor of an air conditioner, main motor of an electric vehicle, and the like has been required. These motors are often used by being rotated at high speed. Accordingly, a non-oriented electrical steel sheet used for an iron core of a motor has been required to improve (reduce) a core loss in a frequency region of 400 Hz to 800 Hz higher than 50 Hz to 60 Hz being a commercial frequency. This is because the reduction in core loss reduces power consumption, thereby allowing an amount of energy consumption to be reduced.

Then, conventionally, as a technique to improve a core loss in a high frequency region, there has been employed a technique of increasing Si and Al contents to thereby increase electrical resistance. Ti is also contained in a raw material of Si and a raw material of Al, and when the Si and Al contents are increased, an amount of Ti to be inevitably mixed in a non-oriented electrical steel sheet is also increased.

In a treatment process of a non-oriented electrical steel sheet, or the like, Ti produces inclusions such as TiN, TiS and TiC, (which will be sometimes described as Ti inclusions, hereinafter), in the non-oriented electrical steel sheet. The Ti inclusions hinder the growth of crystal grains at the time of annealing of the non-oriented electrical steel sheet and suppress the improvement of a magnetic property. Particularly, a large number of Ti inclusions are likely to be finely precipitated in grain boundaries during stress relief annealing. Further, there is sometimes a case that a customer stamps a non-oriented electrical steel sheet shipped by a manufacturer, and thereafter performs stress relief annealing, for example, at 750° C. for two hours or so to thereby grow crystal grains. In the above case, even if Ti inclusions are extremely reduced at the time of shipment, but after the customer performs the stress relief annealing, a large number of Ti inclusions are to exist in the non-oriented electrical steel sheet. Thus, even though the stress relief annealing is performed, the growth of crystal grains is suppressed by a large number of Ti inclusions, so that it is difficult to sufficiently improve the magnetic property.

In order to reduce the Ti inclusions, it is conceivable to use a raw material having a reduced Ti content as the raw material of Si and the raw material of Al, but such a raw material is very expensive. Further, it is also conceivable to reduce N, S, and C contents in the non-oriented electrical steel sheet. It is technically possible to reduce the S and C contents by a vacuum degassing treatment or the like, but a prolonged treatment is required and productivity reduces. Further, a large amount of N is contained in the atmosphere, so that it is difficult to avoid N mixing in molten steel. Even though sealing of a refining vessel is enhanced, the manufacturing cost is only increased, so that it is difficult to sufficiently suppress the mixture of N.

CITATION LIST

Patent Literature

Patent Literature 1: Japanese Laid-open Patent Publication No. 2007-016278

Patent Literature 2: Japanese Laid-open Patent Publication No. 2007-162062

Patent Literature 3: Japanese Laid-open Patent Publication No. 2008-132534

Patent Literature 4: Japanese Laid-open Patent Publication No. 09-316535

Patent Literature 5: Japanese Laid-open Patent Publication No. 08-188825

SUMMARY OF THE INVENTION

Technical Problem

An object of the present invention is to provide a non-oriented electrical steel sheet and a manufacturing method thereof capable of suppressing an increase in core loss due to production of Ti inclusions.

Solution to Problem

The gist of the present invention is as follows.

A non-oriented electrical steel sheet according to a first aspect of the present invention is characterized in that it contains: Si: not less than 1.0 mass % nor more than 3.5 mass %; Al: not less than 0.1 mass % nor more than 3.0 mass %; Mn: not less than 0.1 mass % nor more than 2.0 mass %; Ti: not less than 0.001 mass % nor more than 0.01 mass %; and Bi: not less than 0.001 mass % nor more than 0.01 mass %, a C content being 0.01 mass % or less, a P content being 0.1 mass % or less, a S content being 0.005 mass % or less, a N content being 0.005 mass % or less, and a balance being composed of Fe and inevitable impurities, wherein, when a Ti content (mass %) is represented as [Ti] and a Bi content (mass %) is represented as [Bi], (1) expression described below is satisfied.

$$[Ti] \leq 0.8 \times [Bi] + 0.002 \quad (1)$$

A non-oriented electrical steel sheet according to a second aspect of the present invention is characterized in that in addition to the characteristic of the first aspect, (2) expression described below is further satisfied.

$$[Ti] \leq 0.65 \times [Bi] + 0.0015 \quad (2)$$

A non-oriented electrical steel sheet according to a third aspect of the present invention is characterized in that it contains Si: not less than 1.0 mass % nor more than 3.5 mass %; Al: not less than 0.1 mass % nor more than 3.0 mass %; Mn: not less than 0.1 mass % nor more than 2.0 mass %; Ti: not less than 0.001 mass % nor more than 0.01 mass %; Bi: not less than 0.001 mass % nor more than 0.01 mass %; and at least one selected from a group consisting of REM and Ca, a C content being 0.01 mass % or less, a P content being 0.1 mass % or less, a S content being 0.01 mass % or less, a N content being 0.005 mass % or less, and a balance being composed of Fe and inevitable impurities, wherein, when a Ti content (mass %) is represented as [Ti] and a Bi content (mass %) is represented as [Bi], (1) expression described below is satisfied, and when the S content (mass %) is represented as [S], a REM content (mass %) is represented as [REM], and a Ca content (mass %) is represented as [Ca], (3) expression described below is satisfied.

$$[Ti] \leq 0.8 \times [Bi] + 0.002 \quad (1)$$

$$[S] - (0.23 \times [REM] + 0.4 \times [Ca]) \leq 0.005 \quad (3)$$

Incidentally, REM is a generic term used to refer to 17 elements in total, including 15 elements of lanthanum with an atomic number of 57 to lutetium with an atomic number of 71, and scandium with an atomic number of 21 and yttrium with an atomic number of 39.

Advantageous Effects of Invention

According to the present invention, an appropriate amount of Bi is contained, so that it is possible to suppress production of Ti inclusions to thereby suppress an increase in core loss due to the production of Ti inclusions.

DESCRIPTION OF EMBODIMENTS

Figure 1:
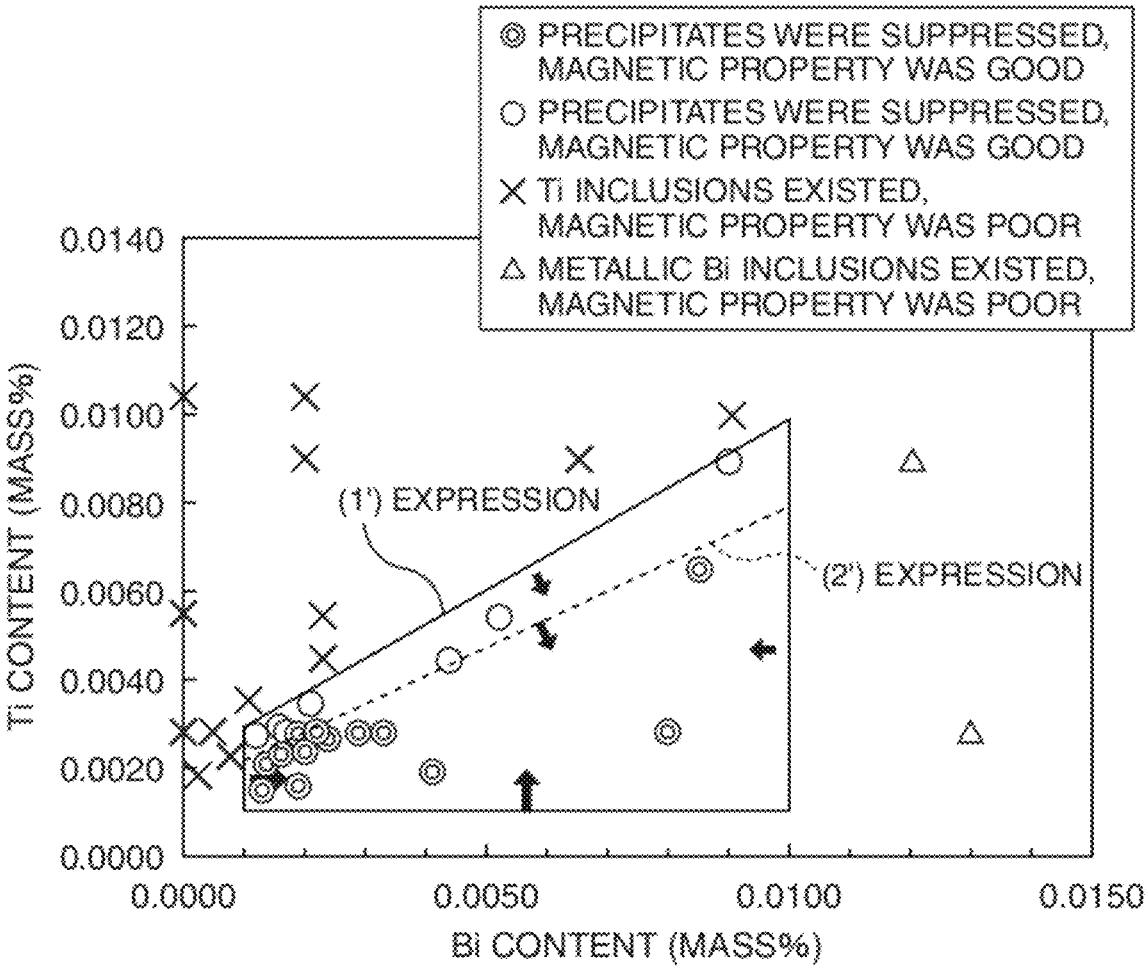
FIG. 1 is a view showing a result of examinations.

The inventors of the present invention newly found out by experiments to be described below that in the case of an appropriate amount of Bi being contained in a non-oriented electrical steel sheet, Ti inclusions (TiN, TiS, and TiC) after annealing is performed are reduced, crystal grains are likely to grow, and a magnetic property is improved.

The inventors of the present invention first prepared steels for a non-oriented electrical steel sheet with a vacuum melting furnace and solidified the steels to thereby obtain slabs. Next, hot rolling of the slabs was performed to obtain hot-rolled steel sheets, and annealing of the hot-rolled steel sheets was performed to obtain annealed steel sheets. Thereafter, cold rolling of the annealed steel sheets was performed to obtain cold-rolled steel sheets, and finish annealing of the cold-rolled steel sheets was performed to obtain non-oriented electrical steel sheets. Further, stress relief annealing of the non-oriented electrical steel sheets was performed. Incidentally, as the steels for the non-oriented electrical steel sheet, there were used ones having various compositions each containing Si: not less than 1.0 mass % nor more than 3.5 mass %, Al: not less than 0.1 mass % nor more than 3.0 mass %, Mn: not less than 0.1 mass % nor more than 2.0 mass %, and Ti: not less than 0.0005 mass % nor more than 0.02 mass %, a C content being 0.01 mass % or less, a P content being 0.1 mass % or less, a S content being 0.005 mass % or less, a N content being 0.005 mass % or less, a Bi content being 0.02 mass % or less, and a balance being composed of Fe and inevitable impurities. Then, examinations of Ti inclusions, crystal grains, and magnetic property were conducted.

In the examination of Ti inclusions, first, the non-oriented electrical steel sheets were each mirror-polished from the surface to a predetermined thickness to manufacture samples for inclusion examination. Then, predetermined etching was performed on the samples, and then replicas of the samples were taken, and Ti inclusions transferred to the replicas were observed with a field emission-type transmission electron microscope and a field emission-type scanning electron microscope. In the etching, the samples were subjected to electrolytic etching in a non-aqueous solvent, with the use of a method proposed by Kurosawa et al. (Fumio Kurosawa, Isao Taguchi, and Ryutaro Matsumoto: Journal of The Japan Institute of Metals, 43 (1979), p. 1068). According to the above etching method, it is possible to dissolve only a base material (the steel) with Ti inclusions remaining in the sample, and to extract the Ti inclusions.

In the examination of grain diameters, the cross sections of the non-oriented electrical steel sheets after the finish annealing were mirror-polished to manufacture samples for crystal grain diameter examination. Then, the samples were subjected to nital etching to allow crystal grains to appear, and an average grain diameter was measured.

In the examination of magnetic property, samples each having a length of 25 cm were cut out of the non-oriented electrical steel sheets, and were subjected to measurement with the use of the Epstein method in accordance with JIS-C-2550.

Incidentally, amounts of TiN, TiS, and metallic Bi inclusions hardly change before and after the stress relief annealing, but TiC is produced in the stress relief annealing. Thus, in order to conduct the examinations of Ti inclusions more securely, in the examinations of TiN and TiS, the samples were manufactured from the non-oriented electrical steel sheets before the stress relief annealing, and in the examination of TiC, the samples were manufactured from the non-oriented electrical steel sheets after the stress relief annealing.

A result of these examinations is shown in FIG. 1.

In FIG. 1, X marks each indicate the sample having a large number of Ti inclusions existing therein and having the poor magnetic property. In these samples, $1\times10^8$ pieces to $3\times10^9$ pieces of TiN and TiS each having an equivalent spherical diameter of 0.01 μm to 0.05 μm existed per 1 $mm^3$ of the non-oriented electrical steel sheet, and 5 pieces to 50 pieces of TiC having an equivalent spherical diameter of 0.01 μm to 0.05 μm existed per 1 μm of the grain boundary. It is conceivable that these Ti inclusions hinder the growth of crystal grains and thereby the magnetic property becomes poor.

In FIG. 1, Δ marks each indicate the sample having a large number of metallic Bi inclusions existing therein and having the poor magnetic property. In these samples, metallic Bi inclusions each being an element having an equivalent spherical diameter of 0.1 μm to a few μm, and/or inclusions in which MnS and a metallic Bi are compositely precipitated, each having an equivalent spherical diameter of 0.1 μm to a few μm were observed. Then, 50 pieces to 2000 pieces of them in total existed per 1 $mm^3$ of the non-oriented electrical steel sheet. The metallic Bi inclusion is one in which supersaturated Bi is precipitated. Further, the inclusion in which MnS and the metallic Bi are compositely precipitated is one in which MnS and a metallic Bi are compositely precipitated because an affinity between Bi and MnS is strong. It is conceivable that these inclusions each containing the metallic Bi hinder the growth of crystal grains, thereby making the magnetic property poor. Incidentally, the metallic Bi inclusions are conceivably produced because Bi is not completely solid-dissolved in a matrix and is not completely segregated in grain boundaries.

In FIG. 1, ○ marks each indicate the sample having reduced Ti inclusions and metallic Bi inclusions and having the good magnetic property. Further, ◎ marks each indicate the sample in which no Ti inclusions and metallic Bi inclusions were observed and the magnetic property was better.

Based on the result shown in FIG. 1, it is found out that even in the case of a small Ti content in the non-oriented electrical steel sheet, when the Bi content is less than 0.001 mass %, a large number of Ti inclusions exist and thereby the magnetic property sometimes becomes poor. Thus, the Bi content of the non-oriented electrical steel sheet is necessary to be 0.001 mass % or more.

Further, it is also found out that as the Ti content of the non-oriented electrical steel sheet becomes higher, the Bi content necessary for obtaining the good magnetic property also becomes higher. However, when the Bi content exceeds 0.01 mass %, a large number of inclusions containing Bi exist, and thereby the magnetic property becomes poor. Consequently, the Bi content of the non-oriented electrical steel sheet is required to be 0.01 mass % or less.

Further, it is also found out that in the case when the Bi content falls within the range of not less than 0.001 mass % nor more than 0.01 mass % and the Ti content is fixed, Ti inclusions are reduced with the increase in Bi content. Then, from the result shown in FIG. 1, a boundary between a region in which X marks are obtained and a region in which ○ marks are obtained is expressed by (1') expression described below when the Bi content falls within the range of not less than 0.001 mass % nor more than 0.01 mass %. Here, [Ti] represents the Ti content (mass %) of the non-oriented electrical steel sheet, and [Bi] represents the Bi content (mass %) of the non-oriented electrical steel sheet. Then, if the Ti content (left side) is equal to or less than the value on the right side, namely (1) expression is established, ○ marks are obtained.

$$[Ti]=0.8\times[Bi]+0.002 \quad (1')$$

$$[Ti]\leq 0.8\times[Bi]+0.002 \quad (1)$$

Furthermore, from the result shown in FIG. 1, a boundary between the region in which ○ marks are obtained and a region in which ◎ marks are obtained is expressed by (2') expression described below when the Bi content falls within the range of not less than 0.001 mass % nor more than 0.01 mass %. Then, if the Ti content (left side) is equal to or less than the value on the right side, namely (2) expression is established, ◎ marks are obtained.

$$[Ti]=0.65\times[Bi]+0.0015 \quad (2')$$

$$[Ti]\leq 0.65\times[Bi]+0.0015 \quad (2)$$

According to these expressions, it is obvious that, for example, in the case of the Ti content being 0.006 mass %, when the Bi content is less than 0.005 mass %, the result of X mark is obtained, and when the Bi content exceeds 0.005 mass %, the result of ○ mark is obtained, and when the Bi content exceeds 0.007 mass %, the result of ◎ mark is obtained. That is, it is obvious that with the increase in Bi content, Ti inclusions are reduced, and as the Bi content becomes much higher, an effect of reducing Ti inclusions is further enhanced. Such a phenomenon was clarified by the inventors of the present invention through the above examinations for the first time. That is, as a result of these examinations, it became obvious that in the case when an appropriate amount of Bi is contained in the non-oriented electrical steel sheet, Ti inclusions after the annealing is performed are reduced and crystal grains are likely to grow, and thereby the magnetic property is improved.

Incidentally, in the case of the Ti content of the non-oriented electrical steel sheet being less than 0.001 mass %, the Ti content is extremely small, resulting in that almost no Ti inclusions are produced. Thus, it is conceivable that in the case of the Ti content being less than 0.001 mass %, the effect of reducing Ti inclusions is hardly obtained.

A mechanism in which the production of Ti inclusions is suppressed in the case of an appropriate amount of Bi being contained in the non-oriented electrical steel sheet has not been clarified. However, considering that the effect is obtained even though the Bi content is a little, which is at most 0.001 mass % or so, and no Bi inclusions are observed, it is conceivable that Bi solid-dissolved in the non-oriented electrical steel sheet and/or Bi segregated in crystal grain boundaries exhibit/exhibits a function to reduce Ti inclusions. Thus, as shown in FIG. 1, (1) expression, and (2) expression, it is conceivable that as the Ti content becomes larger, the Bi content necessary for reducing Ti inclusions is increased, and a proportional relationship is established between the Ti content and the Bi content.

As above, it became obvious that in the case when Bi of not less than 0.001 mass % nor more than 0.01 mass % is contained in the non-oriented electrical steel sheet, as long as (1) expression is satisfied, it is possible to reduce Ti inclusions and metallic Bi inclusions to thereby improve the growth of crystal grains and the magnetic property, and as long as (2) expression is satisfied, it is possible to further reduce Ti inclusions and metallic Bi inclusions to thereby further improve the growth of crystal grains and the magnetic property.

Figure 2:
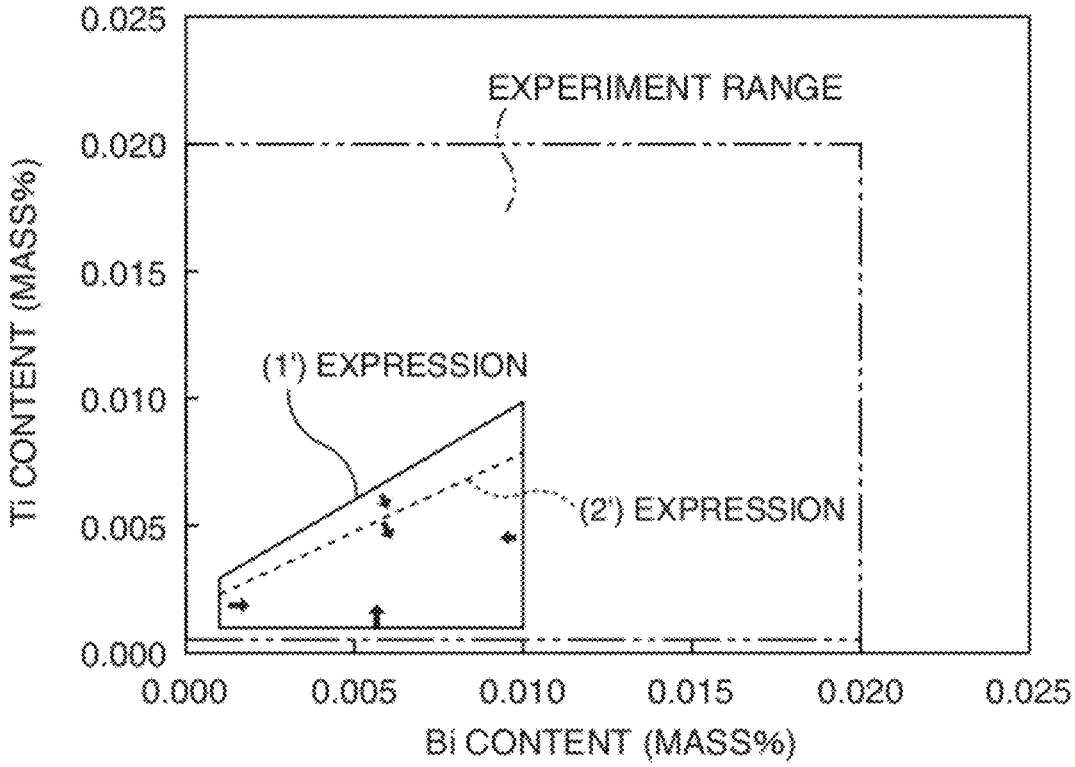
FIG. 2 is a view showing a range of a Ti content and a Bi content.

FIG. 2 shows a range of the Ti content and the Bi content, in which the above-described examinations are conducted, and a range of Bi: not less than 0.001 mass % nor more than 0.01 mass % and Ti: not less than 0.001 mass % nor more 0.01 mass % and in which (1) expression or (2) expression is satisfied.

Further, the inventors of the present invention also conducted an experiment regarding the effect of S in the non-oriented electrical steel sheet. Also in this experiment, first, steels for a non-oriented electrical steel sheet were prepared with a vacuum melting furnace, and the steels were solidified to obtain slabs. Next, hot rolling of the slabs was performed to obtain hot-rolled steel sheets, and annealing of the hot-rolled steel sheets was performed to obtain annealed steel sheets. Thereafter, cold rolling of the annealed steel sheets was performed to obtain cold-rolled steel sheets, and finish annealing of the cold-rolled steel sheets was performed to obtain non-oriented electrical steel sheets. Further, stress relief annealing of the non-oriented electrical steel sheets was performed. Incidentally, as the steels for the non-oriented electrical steel sheet, there were used ones having various compositions each containing Si: not less than 1.0 mass % nor more than 3.5 mass %, Al: not less than 0.1 mass % nor more than 3.0 mass %, Mn: not less than 0.1 mass % nor more than 2.0 mass %, Ti: not less than 0.001 mass % nor more than 0.01 mass %, Bi: not less than 0.001 mass % nor more than 0.01 mass %, and S: not less than 0.001 mass % nor more than 0.015 mass %, a C content being 0.01 mass % or less, a P content being 0.1 mass % or less, a N content being 0.005 mass % or less, a REM content being 0.03 mass % or less, a Ca content being 0.005 mass % or less, and a balance being composed of Fe and inevitable impurities. Then, similarly to the above-described experiment, examinations of Ti inclusions, crystal grains, and magnetic property were conducted.

As a result, it was found out that even in the case when (1) expression or (2) expression is satisfied, the good magnetic property is sometimes not obtained.

As a result of earnest studies on the above cause, it was found out that in the case of S being contained in the non-oriented electrical steel sheet, Bi is compositely precipitated in MnS, so that the amount of Bi exhibiting the function to reduce Ti inclusions is reduced. Particularly, as a larger amount of MnS exists in the non-oriented electrical steel sheet, the amount of Bi to be compositely precipitated in MnS is also increased, so that Ti inclusions are not likely to be reduced.

Thus, it is important that in the case of a certain amount or more of S being contained in the non-oriented electrical steel sheet, MnS is reduced to thereby reduce the amount of Bi to be compositely precipitated in MnS, and thereby the amount of Bi contributing to the reduction in Ti inclusions is secured.

In order to reduce MnS, it is effective to reduce an amount of free S in the non-oriented electrical steel sheet. In the experiment in FIG. 1, it was possible to secure the amount of Di contributing to the reduction in Ti inclusions if (1) expression or (2) expression was satisfied. Accordingly, it is conceivable that if the amount of free S is reduced to the same extent as that in the experiment in FIG. 1 (0.005 mass % or less), the amount of Bi contributing to the reduction in Ti inclusions can be secured.

Based on such knowledge, the inventors of the present invention found out that even in the case when S being larger than 0.005 mass % is contained in the non-oriented electrical steel sheet, as long as an appropriate amount of at least one type of REM and Ca being desulfurizing elements is contained in the non-oriented electrical steel sheet, sulfides of REM or Ca are produced, so that the amount of free S is reduced to 0.005 mass % or less, thereby allowing the amount of Bi contributing to the reduction in Ti inclusions to be secured.

That is, as a result of examination of a relationship between MnS and metallic Bi inclusions in the non-oriented electrical steel sheet, which was conducted by the inventors of the present invention, it became obvious that in the case of (3) expression described below being satisfied, metallic Bi inclusions are not likely to be compositely precipitated in MnS. Here, [S] represents a S content (mass %) of the non-oriented electrical steel sheet, [REM] represents the REM content (mass %) of the non-oriented electrical steel sheet, and [Ca] represents the Ca content (mass %) of the non-oriented electrical steel sheet.

$$[S]-(0.23\times[REM]+0.4\times[Ca])\leq 0.005 \quad (3)$$

REM turns to oxides, oxysulfides, and/or sulfides in the non-oriented electrical steel sheet. When a mass ratio of S to REM in REM oxysulfides and REM sulfides was examined, the mass ratio was 0.23 on the average.

Ca produces Ca sulfides in the non-oriented electrical steel sheet. A mass ratio of S to Ca in Ca sulfides is 0.8, but as a result of examination, half an amount of Ca in the non-oriented electrical steel sheet produced Ca sulfides. That is, the mass ratio of S to Ca in Ca sulfides was 0.4.

From the results of these examinations, the amount of free S from which S fixed by REM inclusions or Ca inclusions is eliminated is expressed by the left side of (3) expression. Then, if the above value of the amount is 0.005 mass % or less, metallic Bi inclusions to be compositely precipitated in MnS are significantly reduced, thereby allowing the amount of Bi contributing to the reduction in Ti inclusions to be secured.

Such a functional effect of Bi is to bring about the reduction in Ti inclusions in the non-oriented electrical steel sheet. That is, Bi suppresses precipitations of TiN and TiS in the annealing of the hot-rolled sheet and the finish annealing of the cold-rolled sheet, and further suppresses precipitation of TiC in the stress relief annealing.

Next, the reason of limiting components of the non-oriented electrical steel sheet will be explained.

[C]: C forms TiC in the non-oriented electrical steel sheet to cause deterioration of the magnetic property. Further, magnetic aging becomes noticeable by precipitation of C. Thus, the C content is set to 0.01 mass % or less. C needs not be contained in the non-oriented electrical steel sheet, but when the cost required for decarburization is considered, the C content is preferably 0.0005 mass % or more.

[Si]: Si is an element to reduce a core loss. When a Si content is less than 1.0 mass %, a core loss cannot be reduced sufficiently. On the other hand, when the Si content exceeds 3.5 mass %, workability is reduced significantly. Thus, the Si content is not less than 1.0 mass % nor more than 3.5 mass %. In order to further reduce a core loss, the Si content is preferably 1.5 mass % or more, and is more preferably 2.0 mass % or more. Further, in order to further improve workability at the time of cold rolling, the Si content is preferably 3.1 mass % or less, and is more preferably 3.0 mass % or less, and is still more preferably 2.5 mass %.

[Al]: Al is, similarly to Si, an element to reduce a core loss. When an Al content is less than 0.1 mass %, a core loss cannot be reduced sufficiently. On the other hand, when the Al content exceeds 3.0 mass %, an increase in cost becomes noticeable. Thus, the Al content is not less than 0.1 mass % nor more than 3.0 mass %. In order to further reduce a core loss, the Al content is preferably 0.2 mass % or more, and is more preferably 0.3 mass % or more, and is still more preferably 0.4 mass % or more. Further, for reducing the cost, the Al content is preferably 2.5 mass % or less, and is more preferably 2.0 mass % or less, and is still more preferably 1.8 mass % or less.

[Mn]: Mn increases the hardness of the non-oriented electrical steel sheet to improve a stamping property. When a Mn content is less than 0.1 mass %, such an effect is not obtained. On the other hand, when the Mn content exceeds 2.0 mass %, an increase in cost becomes noticeable. Thus, the Mn content is not less than 0.1 mass % nor more than 2.0 mass %.

[P]: P increases the strength of the non-oriented electrical steel sheet to improve its workability. When the P content is less than 0.0001 mass %, such an effect is not likely to be obtained. Thus, the P content is preferably 0.0001 mass % or more. On the other hand, when the P content exceeds 0.1 mass %, workability at cold rolling is reduced. Thus, the P content is 0.1 mass % or less.

[Bi]: Bi suppresses the production of Ti inclusions as described above, but when the Bi content is less than 0.001 mass %, such an effect is not obtained. On the other hand, when the Bi content exceeds 0.01 mass %, metallic Bi inclusions is produced, and inclusions in which MnS and metallic Bi are compositely precipitated are produced, and thereby the growth of crystal grains is hindered and the good magnetic property is not obtained, as described above. Thus, the Bi content is not less than 0.001 mass % nor more than 0.01 mass %. In order to further suppress the production of Ti inclusions, the Bi content is preferably 0.0015 mass % or more, and is more preferably 0.002 mass % or more, and is still more preferably 0.003 mass % or more. Further, for the reduction in cost, the Bi content is preferably 0.005 mass % or less. Furthermore, as described above, (1) expression is required to be satisfied, and (2) expression is preferably satisfied.

[S]: S produces sulfides such as TiS and MnS. Then, TiS prevents the growth of crystal grains to thereby increase a core loss. Further, MnS functions as a site in which metallic Bi is compositely precipitated, and reduces the effect of suppressing the production of Ti inclusions by Bi. Thus, in the case when later-described amounts of REM and Ca are not contained in the non-oriented electrical steel sheet, the S content is 0.005 mass % or less, and is preferably 0.003 mass % or less. On the other hand, in the case when the later-described amounts of REM and Ca are contained in the non-oriented electrical steel sheet, the S content may also exceed 0.005 mass %, but the S content is 0.01 mass % or less. This is because when the S content exceeds 0.01 mass %, sulfides of REM and Ca are increased to thereby hinder the growth of crystal grains. Incidentally, the S content may also be 0 mass %.

[N]: N produces nitrides such as TiN to make a core loss deteriorate. Thus, the N content is 0.005 mass % or less, and is preferably 0.003 mass % or less, and is more preferably 0.0025 mass % or less, and is still more preferably 0.002 mass % or less. However, it is difficult to eliminate N completely, so that N may remain in the non-oriented electrical steel sheet and the N content may also be larger than 0 mass %. For example, the N content may also be 0.001 mass % or more in consideration of denitrification available in an industrial manufacturing process. Further, in the case when denitrification is performed extremely, when the N content is reduced to 0.0005 mass %, nitrides are further reduced, so that it is preferable.

[Ti]: Ti produces Ti precipitates of TiN, TiS, TiC, and so on (fine inclusions) to thereby hinder the growth of crystal grains and make a core loss deteriorate. The production of these fine inclusions is suppressed because Bi is contained in the non-oriented electrical steel sheet, and as described above, (1) expression is satisfied between the Bi content and the Ti content. Further, the Bi content is 0.01 mass % or less. Thus, the Ti content is 0.01 mass % or less. Further, as described above, (2) expression is preferably satisfied. Incidentally, in the case of the Ti content being less than 0.001 mass %, a produced amount of Ti precipitates becomes extremely small, and thereby the growth of crystal grains is hardly hindered even though Bi is not contained in the non-oriented electrical steel sheet. That is, in the case of the Ti content being less than 0.001 mass %, the effect ascribable to the content of Bi is not likely to appear. Thus, the Ti content is 0.001 mass % or more.

[REM] and [Ca]: REM and Ca are desulfurizing elements to fix S in the non-oriented electrical steel sheet and suppress the production of sulfide inclusions such as MnS. Thus, in the case when the S content larger than 0.005 mass % is contained in the non-oriented electrical steel sheet, (3) expression is required to be satisfied. In order to obtain the above effect more securely, the REM content is preferably 0.001 mass % or more, and the Ca content is preferably 0.0003 mass % or more. On the other hand, when the REM content exceeds 0.02 mass %, the cost is increased significantly. Further, when the Ca content exceeds 0.0125 mass %, a melting loss of a furnace refractory and the like sometimes occur. Thus, the REM content is preferably 0.02 mass % or less, and the Ca content is preferably 0.0125 mass % or less. Incidentally, the type of element of REM is not limited in particular, and only one type may be contained, or two types or more may also be contained, and as long as (3) expression is satisfied, the effect is obtained.

In the non-oriented electrical steel sheet, elements described below may also be contained. Incidentally, these elements need not be contained in the non-oriented electrical steel sheet, but if even a small amount of the elements is contained in the non-oriented electrical steel sheet, the effect is achieved. Thus, a content of these elements is preferably larger than 0 mass %.

[Cu]: Cu improves the corrosion resistance and further increases the resistivity to thereby improve a core loss. In order to obtain the above effect, a Cu content is preferably 0.005 mass % or more. However, when the Cu content exceeds 0.5 mass %, scab and the like occur on the surface of the non-oriented electrical steel sheet, and thereby the surface quality is likely to deteriorate. Thus, the Cu content is preferably 0.5 mass % or less.

[Cr]: Cr improves the corrosion resistance and further increases the resistivity to thereby improve a core loss. In order to obtain the above effect, a Cr content is preferably 0.005 mass % or more. However, when the Cr content exceeds 20 mass %, the cost is likely to be increased. Thus, the Cr content is preferably 20 mass % or less.

[Sn] and [Sb]: Sn and Sb are segregation elements and hinder the growth of a texture on the (111) plane, which makes the magnetic property deteriorate, to thereby improve the magnetic property. Even though only either Sn or Sb is contained, or both Sn and Sb are contained in the non-oriented electrical steel sheet, the effect is obtained. In order to obtain the effect, a content of Sn and Sb is preferably 0.001 mass % or more in total. However, when the content of Sn and Sb exceeds 0.3 mass % in total, workability in the cold rolling is likely to deteriorate. Thus, the content of Sn and Sb is preferably 0.3 mass % or less in total.

[Ni]: Ni develops a texture advantageous to the magnetic property to thereby improve a core loss. In order to obtain the above effect, a Ni content is preferably 0.001 mass % or more. However, when the Ni content exceeds 1.0 mass %, the cost is likely to be increased. Thus, the Ni content is preferably 1.0 mass % or less.

Incidentally, as the inevitable impurities, ones in the following are cited.

[Zr]: Zr, even in a small amount, is likely to hinder the growth of crystal grains, and thereby a core loss after the stress relief annealing is likely to deteriorate. Thus, a Zr content is preferably 0.01 mass % or less.

[V]: V is likely to produce nitrides or carbides and is likely to hinder the displacement of a magnetic domain wall and the growth of crystal grains. Thus, a V content is preferably 0.01 mass % or less.

[Mg]: Mg is a desulfurizing element and reacts with S in the non-oriented electrical steel sheet to produce sulfides and fixes S. As a Mg content is increased, a desulfurizing effect is enhanced, but when the Mg content exceeds 0.05 mass %, Mg sulfides are produced excessively and thereby the growth of crystal grains is likely to be prevented. Thus, the Mg content is preferably 0.05 mass % or less.

[O]: When an O content that is dissolved and non-dissolved exceeds 0.005 mass % in total amount, a large number of oxides is produced, and thereby the oxides are likely to hinder the displacement of a magnetic domain wall and the growth of crystal grains. Thus, the O content is preferably 0.005 mass % or less.

[B]: B is a grain boundary segregation element and further produces nitrides. B nitrides hinder the migration of grain boundaries, and thereby a core loss is likely to deteriorate. Thus, a B content is preferably 0.005 mass % or less.

According to the non-oriented electrical steel sheet as above, it is possible to suppress a core loss low even though the annealing such as stress relief annealing is performed thereafter. That is, the occurrence of Ti inclusions at the time of annealing is suppressed to sufficiently grow crystal grains, and thereby it is possible to obtain a low core loss. Accordingly, the good magnetic property can be obtained without using a method of causing a noticeable increase in cost or a noticeable reduction in productivity. Then, in the case when the non-oriented electrical steel sheet as above is used for a motor, energy consumption can be reduced.

Next, an embodiment of a manufacturing method of a non-oriented electrical steel sheet will be explained.

First, at a steelmaking stage, steel is refined with a converter, a secondary refining furnace, or the like, and the molten steel with the contents of the respective elements except Bi falling within the above-described ranges is produced. At this time, in the case when desulfurization is performed until the S content becomes 0.005 mass % or less, REM and Ca are not required to be added to the steel, but in the case when desulfurization is performed until the S content becomes larger than 0.005 mass % and 0.01 mass % or less, REM and/or Ca are/is added to the steel in a secondary refining furnace or the like such that (3) expression is satisfied.

Thereafter, the molten steel is received in a ladle, and the molten steel is poured into a mold through a tundish while adding Bi to the molten steel, and by continuous casting or ingot casting, a cast steel such as a slab is produced. That is, Bi is added to the molten steel in the middle of being poured into the mold. At this time, Bi is preferably added to the molten steel immediately before the molten steel is poured into the mold as much as possible. This is because the boiling point of Bi is 1560° C., but the temperature of the molten steel at the time of being poured into the mold is higher than 1560° C., so that Bi poured into the mold early is vaporized over time to be lost.

Figure 3:
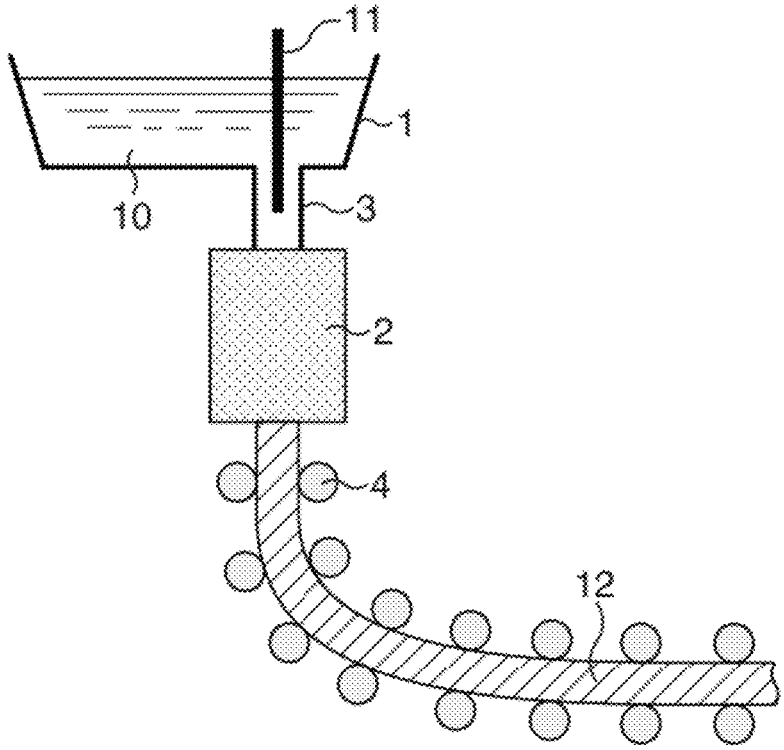
FIG. 3 is a view showing one example of an addition method of Bi.

The inventors of the present invention found out in the experiment that heating, dissolving, boiling, and vaporizing of Bi by the molten steel become noticeable after three minutes and later after the addition of Bi. Thus, in terms of a yield of Bi, Bi is preferably added to the molten steel such that the time period from the addition of Bi to the start of solidification of the molten steel becomes three minutes or shorter. For example, as shown in FIG. 3, it is preferable that a wire-shaped metallic Bi 11 is supplied to molten steel 10 in the vicinity of a pouring port 3, provided at a bottom portion of a tundish 1, into a mold 2. According to the above method, it is possible to adjust the time period from the dissolution of the metallic Bi 11 in the molten steel 10 to the start of solidification of the molten steel 10 in the mold 2 to within three minutes. The molten steel 10 is solidified and then is discharged as a cast steel 12, and the cast steel 12 is conveyed by a conveyor roller 4.

Incidentally, the yield of Bi varies depending on the temperature of the molten steel and the timing of the addition, but falls within a range of 5% to 15% on the whole, and if the yield of Bi is measured in advance, it is possible to determine its amount to be added in consideration of the yield.

Further, metallic Bi may also be added to the molten steel directly, but if Bi is covered with Fe or the like to be added to the molten steel, the loss due to vaporization is reduced, thereby allowing the yield to be improved.

Thus, in order to set the Bi content of the non-oriented electrical steel sheet to not less than 0.001% nor more than 0.01%, it is preferable that the yield of Bi when Bi covered with, for example, Fe is added to the molten steel is measured in advance according to a relationship between the temperature of the molten steel and the timing of the addition, and the amount of Bi in which the value of the above yield is considered is added to the molten steel at predetermined timing.

After the cast steel is obtained in this manner, the cast steel is hot rolled to obtain a hot-rolled steel sheet. Then, the hot-rolled steel sheet is hot-rolled sheet annealed according to need and then is cold rolled, and thereby a cold-rolled steel sheet is obtained. The thickness of the cold-rolled steel sheet is set to the thickness of the non-oriented electrical steel sheet to be manufactured, for example. The cold rolling may be performed only one time, or may also be performed two times or more with intermediate annealing therebetween. Subsequently, the cold-rolled steel sheet is finish-annealed, and an insulating film is coated thereon. According to the method as above, it is possible to obtain the non-oriented electrical steel sheet in which the occurrence of Ti inclusions is suppressed.

Incidentally, the method of examining the inclusions, the method of measuring the magnetic property, and the like are not limited to the ones described above. For example, it is also possible that in the examination of Ti inclusions, the replica method is not employed but thin film samples are made and Ti inclusions are observed with the use of a field emission-type transmission electron microscope.

Example

Next, experiments conducted by the present inventors will be explained. The conditions and so on in the experiments are examples employed for confirming the practicability and the effects of the present invention, and the present invention is not limited to these examples.

First Experiment

First, steels each containing C: 0.0017 mass %, Si: 2.9 mass %, Mn: 0.5 mass %, P: 0.09 mass %, S: 0.0025 mass %, Al: 0.4 mass %, and N: 0.0023 mass %, and further containing components shown in Table 1 and a balance being composed of Fe and inevitable impurities were refined in a converter and a vacuum degassing apparatus and each received in a ladle. Next, the molten steels were each supplied into a mold with an immersion nozzle through a tundish, and cast steels were obtained through continuous casting. Incidentally, addition of Bi was performed in a manner that a wire-shaped metallic Bi having a diameter of 5 mm, which was covered with a Fe film having a thickness of 1 mm, was put into the molten steel in the tundish from the position directly above the immersion nozzle to the mold. At this time, the position from which the metallic Bi was put into the molten steel was determined such that the time period from the addition of Bi to the start of solidification of the molten steel became 1.5 minutes.

TABLE 1

| | | COMPOSITION | | | | | | | | |
|---|---|---|---|---|---|---|---|---|---|---|
| | | CONTENT (MASS %) | | | | | | | RELATIONSHIP BETWEEN (1) EXPRESSION AND | EVALUATION OF Bi |
| | No. | Ti | Bi | Cr | Cu | Sn | Sb | Ni | (2) EXPRESSION | CONTENT |
| EXAMPLE | 1 | 0.0015 | 0.0013 | 0 | 0 | 0 | 0 | 0 | ◎ | ○ |
| | 2 | 0.0016 | 0.0019 | 0 | 0 | 0 | 0 | 0 | ◎ | ○ |
| | 3 | 0.0019 | 0.0041 | 0 | 0 | 0 | 0 | 0 | ◎ | ○ |
| | 4 | 0.0024 | 0.0020 | 0 | 0 | 0 | 0 | 0 | ◎ | ○ |
| | 5 | 0.0028 | 0.0012 | 0 | 0 | 0 | 0 | 0 | ○ | ○ |
| | 6 | 0.0028 | 0.0033 | 0 | 0 | 0 | 0 | 0 | ◎ | ○ |
| | 7 | 0.0028 | 0.0080 | 0 | 0 | 0 | 0 | 0 | ◎ | ○ |
| | 8 | 0.0028 | 0.0017 | 0 | 0 | 0 | 0 | 0 | ○ | ○ |
| | 9 | 0.0028 | 0.0019 | 0 | 0 | 0 | 0 | 0 | ○ | ○ |
| | 10 | 0.0029 | 0.0016 | 0 | 0 | 0 | 0 | 0 | ○ | ○ |
| | 11 | 0.0035 | 0.0021 | 0 | 0 | 0 | 0 | 0 | ○ | ○ |
| | 12 | 0.0045 | 0.0044 | 0 | 0 | 0 | 0 | 0 | ○ | ○ |
| | 13 | 0.0055 | 0.0052 | 0 | 0 | 0 | 0 | 0 | ○ | ○ |

TABLE 1-continued

| | | COMPOSITION | | | | | | | | |
|---|---|---|---|---|---|---|---|---|---|---|
| | | CONTENT (MASS %) | | | | | | | RELATIONSHIP BETWEEN (1) EXPRESSION AND | EVALUATION OF Bi |
| No. | | Ti | Bi | Cr | Cu | Sn | Sb | Ni | (2) EXPRESSION | CONTENT |
| | 14 | 0.0066 | 0.0085 | 0 | 0 | 0 | 0 | 0 | ◎ | ○ |
| | 15 | 0.0090 | 0.0090 | 0 | 0 | 0 | 0 | 0 | ○ | ○ |
| | 16 | 0.0021 | 0.0014 | 1.8 | 0 | 0 | 0 | 0 | ◎ | ○ |
| | 17 | 0.0028 | 0.0022 | 0 | 0.14 | 0 | 0 | 0 | ◎ | ○ |
| | 18 | 0.0028 | 0.0029 | 0 | 0 | 0.08 | 0 | 0 | ◎ | ○ |
| | 19 | 0.0023 | 0.0016 | 0 | 0 | 0 | 0.1 | 0 | ◎ | ○ |
| | 20 | 0.0027 | 0.0024 | 0 | 0 | 0 | 0 | 0.45 | ◎ | ○ |
| COMPARATIVE EXAMPLE | 21 | 0.0028 | 0 | 0 | 0 | 0 | 0 | 0 | X | X |
| | 22 | 0.0055 | 0 | 0 | 0 | 0 | 0 | 0 | X | X |
| | 23 | 0.0104 | 0 | 0 | 0 | 0 | 0 | 0 | X | X |
| | 24 | 0.0018 | 0.0003 | 0 | 0 | 0 | 0 | 0 | ○ | X |
| | 25 | 0.0022 | 0.0008 | 0 | 0 | 0 | 0 | 0 | ○ | X |
| | 26 | 0.0028 | 0.0005 | 0 | 0 | 0 | 0 | 0 | ○ | X |
| | 27 | 0.0035 | 0.0011 | 0 | 0 | 0 | 0 | 0 | X | ○ |
| | 28 | 0.0045 | 0.0023 | 0 | 0 | 0 | 0 | 0 | X | ○ |
| | 29 | 0.0055 | 0.0023 | 0 | 0 | 0 | 0 | 0 | X | ○ |
| | 30 | 0.0090 | 0.0020 | 0 | 0 | 0 | 0 | 0 | X | ○ |
| | 31 | 0.0090 | 0.0065 | 0 | 0 | 0 | 0 | 0 | X | ○ |
| | 32 | 0.0104 | 0.0020 | 0 | 0 | 0 | 0 | 0 | X | ○ |
| | 33 | 0.0100 | 0.0090 | 0 | 0 | 0 | 0 | 0 | X | ○ |
| | 34 | 0.0028 | 0.0130 | 0 | 0 | 0 | 0 | 0 | ◎ | X |
| | 35 | 0.0028 | 0.0200 | 0 | 0 | 0 | 0 | 0 | ◎ | X |
| | 36 | 0.0090 | 0.0120 | 0 | 0 | 0 | 0 | 0 | ◎ | X |

Thereafter, the cast steels were hot rolled to obtain hot-rolled steel sheets. Next, the hot-rolled steel sheets were hot-rolled sheet annealed and subsequently were cold rolled, and thereby cold-rolled steel sheets each having a thickness of 0.35 mm were obtained. Thereafter, the cold-rolled steel sheets were subjected to finish annealing at 950° C. for 30 seconds, and an insulating film was coated thereon, and thereby non-oriented electrical steel sheets were obtained. The grain diameter of each of the obtained non-oriented electrical steel sheets was in a range of 50 μm to 75 μm.

Then, examinations of TiN, TiS, and metallic Bi inclusions, and magnetic property were conducted. The examinations of TiN, TiS, and metallic Bi inclusions were conducted by the above-described replica method. Further, in the examination of magnetic property, a core loss W10/800 was measured by the above-described Epstein method in accordance with JIS-C-2550. A result thereof is shown in Table 2. Incidentally, in Table 2, in the section of "TiN and TiS", "Existence" means that $1\times10^8$ pieces to $3\times10^9$ pieces of TiN or TiS having an equivalent spherical diameter of 0.01 μm to 0.05 μm existed per 1 $mm^3$ of the non-oriented electrical steel sheet in the field of view, and "NONEXISTENCE" means that the number of pieces of TiN or TiS as above was less than $1\times10^8$ per 1 $mm^3$ of the non-oriented electrical steel sheet in the field of view. Further, in the section of "METALLIC Bi INCLUSION", "EXISTENCE" means that in the field of view, 50 pieces to 2000 pieces of metallic Bi inclusions each being an element having an equivalent spherical diameter of 0.1 μm to a few μm and inclusions in which MnS and the metallic Bi were compositely precipitated, each having an equivalent spherical diameter of 0.1 μm to a few μm existed per 1 $mm^3$ of the non-oriented electrical steel sheet in total, and "NONEXISTENCE" means that the number of such inclusions was less than 50 per 1 $mm^3$ of the non-oriented electrical steel sheet.

Further, stress relief annealing at 750° C. for two hours was performed on the non-oriented electrical steel sheets, and then examinations of average grain diameter, TiC, and magnetic property were conducted. The examination of crystal grain diameter was conducted by the above-described method in which nital etching is performed, and the examination of TiC was conducted by the above-described replica method. Further, in the examination of magnetic property, the core loss W10/800 was measured by the above-described Epstein method in accordance with JIS-C-2550. A result thereof is also shown in Table 2. Incidentally, in Table 2, the section of "TiC DENSITY ON GRAIN BOUNDARY" indicates the number of pieces of TiC having an equivalent spherical diameter of 100 nm or less per 1 μm of the grain boundary.

TABLE 2

| | | BEFORE STRESS RELIEF ANNEALING | | | AFTER STRESS RELIEF ANNEALING | | |
|---|---|---|---|---|---|---|---|
| No. | | TiN AND TiS | METALLIC Bi INCLUSION | CORE LOSS W10/800 (W/kg) | AVERAGE GRAIN DIAMETER | TiC DENSITY ON GRAIN BOUNDARY (PIECE/μm) | CORE LOSS W10/800 (W/kg) |
| EXAMPLE | 1 | NONEXISTENCE | NONEXISTENCE | 60.8 | 100 | 0 | 52.4 |
| | 2 | NONEXISTENCE | NONEXISTENCE | 60.0 | 105 | 0 | 52.3 |
| | 3 | NONEXISTENCE | NONEXISTENCE | 60.5 | 105 | 0 | 52.2 |
| | 4 | NONEXISTENCE | NONEXISTENCE | 60.2 | 100 | 0 | 52.5 |
| | 5 | NONEXISTENCE | NONEXISTENCE | 60.3 | 100 | 1 | 54.0 |

TABLE 2-continued

| | | BEFORE STRESS RELIEF ANNEALING | | | AFTER STRESS RELIEF ANNEALING | | |
|---|---|---|---|---|---|---|---|
| | No. | TiN AND TiS | METALLIC Bi INCLUSION | CORE LOSS W10/800 (W/kg) | AVERAGE GRAIN DIAMETER | TiC DENSITY ON GRAIN BOUNDARY (PIECE/μm) | CORE LOSS W10/800 (W/kg) |
| | 6 | NONEXISTENCE | NONEXISTENCE | 59.5 | 105 | 0 | 52.5 |
| | 7 | NONEXISTENCE | NONEXISTENCE | 60.2 | 100 | 0 | 52.8 |
| | 8 | NONEXISTENCE | NONEXISTENCE | 59.9 | 100 | 1 | 53.4 |
| | 9 | NONEXISTENCE | NONEXISTENCE | 59.2 | 100 | 1 | 53.3 |
| | 10 | NONEXISTENCE | NONEXISTENCE | 59.3 | 100 | 1 | 53.4 |
| | 11 | NONEXISTENCE | NONEXISTENCE | 59.9 | 100 | 1 | 53.6 |
| | 12 | NONEXISTENCE | NONEXISTENCE | 60.2 | 100 | 1 | 53.4 |
| | 13 | NONEXISTENCE | NONEXISTENCE | 60.3 | 100 | 1 | 53.5 |
| | 14 | NONEXISTENCE | NONEXISTENCE | 59.7 | 105 | 0 | 52.9 |
| | 15 | NONEXISTENCE | NONEXISTENCE | 60.8 | 100 | 1 | 53.5 |
| | 16 | NONEXISTENCE | NONEXISTENCE | 59.9 | 100 | 0 | 52.6 |
| | 17 | NONEXISTENCE | NONEXISTENCE | 59.1 | 105 | 0 | 52.2 |
| | 18 | NONEXISTENCE | NONEXISTENCE | 59.6 | 105 | 0 | 52.5 |
| | 19 | NONEXISTENCE | NONEXISTENCE | 60.1 | 100 | 0 | 52.8 |
| | 20 | NONEXISTENCE | NONEXISTENCE | 59.7 | 100 | 0 | 52.6 |
| COMPARATIVE EXAMPLE | 21 | EXISTENCE | NONEXISTENCE | 64.5 | 85 | 18 | 59.4 |
| | 22 | EXISTENCE | NONEXISTENCE | 63.8 | 80 | 25 | 62.0 |
| | 23 | EXISTENCE | NONEXISTENCE | 69.0 | 65 | 41 | 67.2 |
| | 24 | EXISTENCE | NONEXISTENCE | 62.7 | 95 | 8 | 57.7 |
| | 25 | EXISTENCE | NONEXISTENCE | 64.2 | 85 | 10 | 58.3 |
| | 26 | EXISTENCE | NONEXISTENCE | 64.2 | 90 | 8 | 57.7 |
| | 27 | EXISTENCE | NONEXISTENCE | 63.9 | 85 | 9 | 57.9 |
| | 28 | EXISTENCE | NONEXISTENCE | 63.1 | 85 | 7 | 57.4 |
| | 29 | EXISTENCE | NONEXISTENCE | 63.3 | 90 | 6 | 56.1 |
| | 30 | EXISTENCE | NONEXISTENCE | 63.3 | 85 | 20 | 58.3 |
| | 31 | EXISTENCE | NONEXISTENCE | 61.9 | 90 | 9 | 58.1 |
| | 32 | EXISTENCE | NONEXISTENCE | 62.9 | 75 | 30 | 61.1 |
| | 33 | EXISTENCE | NONEXISTENCE | 67.8 | 70 | 26 | 55.3 |
| | 34 | NONEXISTENCE | EXISTENCE | 63.8 | 80 | 0 | 56.5 |
| | 35 | NONEXISTENCE | EXISTENCE | 68.4 | 70 | 0 | 60.5 |
| | 36 | NONEXISTENCE | EXISTENCE | 61.1 | 90 | 0 | 55.9 |

As shown in Table 2, in Examples No. 1 to No. 20 belonging to the range of the present invention, before the stress relief annealing, almost no TiN, TiS, and metallic Bi inclusions existed and the value of the core loss was good. Further, after the stress relief annealing, almost no TiC on grain boundaries also existed, and crystal grains grew relatively coarsely and the value of the core loss was good.

On the other hand, in Comparative Examples No. 21 to No. 26, the Bi content was less than the lower limit of the range of the present invention, so that before the stress relief annealing, a large number of pieces of TiN and TiS existed, and after the stress relief annealing, a large number of pieces of TiC existed. Then, the values of the core loss before and after the stress relief annealing were significantly large as compared with those in Examples No. 1 to No. 20, and crystal grains did not grow very much as compared with Examples No. 1 to No. 20. Further, in Comparative Examples No. 27 to No. 33, (1) expression was not satisfied, so that before the stress relief annealing, a large number of pieces of TiN and TiS existed, and after the stress relief annealing, a large number of pieces of TiC existed. Then, the values of the core loss before and after the stress relief annealing were significantly large as compared with those in Examples No. 1 to No. 20, and crystal grains did not grow very much as compared with Examples No. 1 to No. 20. Furthermore, in Comparative Examples No. 34 to No. 36, the Bi content exceeded the upper limit of the range of the present invention, so that before the stress relief annealing, a large number of metallic Bi inclusions existed, and the values of the core loss before and after the stress relief annealing were significantly large as compared with those in Examples No. 1 to No. 20.

Incidentally, the states of TiN, TiS, and metallic Bi inclusions hardly change before and after the stress relief annealing, but TiC is produced in the stress relief annealing. Thus, in order to conduct the observation of Ti inclusions more securely, the measurements of TiN and TiS were conducted before the stress relief annealing, and the measurement of TiC was conducted after the stress relief annealing.

Second Experiment

First, steels each containing C: 0.002 mass %, Si: 3.0 mass %, Mn: 0.20 mass %, P: 0.1 mass %, Al: 1.05 mass %, Ti: 0.003 mass %, N: 0.002 mass %, and Bi: 0.0025 mass %, and further containing components shown in Table 3, and a balance being composed of Fe and inevitable impurities were melted in a high-frequency vacuum melting apparatus. At this time, a misch metal was added to the molten steels and thereby REM was contained in the steels, and a metallic Ca was added to the molten steels and thereby Ca was contained in the molten steels. After the molten steels each having the above-described components were obtained, a metallic Bi was further added to the molten steels directly, and thereafter, the molten steels were each poured into a mold and ingots were obtained. Incidentally, the time period from the addition of the metallic Bi to the start of solidification of the molten steel was set to two minutes. Incidentally, the value of REM content in Table 3 is a result of a chemical analysis of La and Ce.

TABLE 3

| | No. | COMPOSITION CONTENT (ppm) S | REM | Ca | VALUE OF LEFT SIDE OF (3) EXPRESSION (ppm) |
|---|---|---|---|---|---|
| EXAMPLE | 41 | 10 | 0 | 0 | 10 |
| | 42 | 25 | 0 | 0 | 25 |
| | 43 | 48 | 0 | 0 | 48 |
| | 44 | 60 | 60 | 0 | 46 |
| | 45 | 55 | 0 | 30 | 43 |
| | 46 | 65 | 48 | 15 | 48 |
| | 47 | 84 | 120 | 19 | 49 |
| COMPARATIVE EXAMPLE | 48 | 56 | 0 | 0 | 56 |
| | 49 | 70 | 15 | 10 | 63 |
| | 50 | 100 | 0 | 0 | 100 |
| | 51 | 120 | 220 | 30 | 57 |

Thereafter, the ingots were hot rolled, and thereby hot-rolled steel sheets were obtained. Next, the hot-rolled steel sheets were hot-rolled sheet annealed, and subsequently were cold rolled, and thereby cold-rolled steel sheets each having a thickness of 0.35 mm were obtained. Thereafter, finish annealing at 950° C. for 30 seconds was performed on the cold-rolled steel sheets, and thereby non-oriented electrical steel sheets were obtained.

Then, similarly to First Experiment, examinations of TiN, TiS, metallic Bi inclusions, and magnetic property were conducted. A result thereof is shown in Table 4.

TABLE 4

| | No. | TiN AND TiS | METALLIC Bi INCLUSION | CORE LOSS W10/800 (W/kg) |
|---|---|---|---|---|
| EXAMPLE | 41 | NONEXISTENCE | NONEXISTENCE | 32.6 |
| | 42 | NONEXISTENCE | NONEXISTENCE | 32.9 |
| | 43 | NONEXISTENCE | NONEXISTENCE | 33.0 |
| | 44 | NONEXISTENCE | NONEXISTENCE | 33.4 |
| | 45 | NONEXISTENCE | NONEXISTENCE | 33.3 |
| | 46 | NONEXISTENCE | NONEXISTENCE | 32.9 |
| | 47 | NONEXISTENCE | NONEXISTENCE | 33.0 |
| COMPARA-TIVE EXAMPLE | 48 | EXISTENCE | EXISTENCE | 36.7 |
| | 49 | EXISTENCE | EXISTENCE | 35.6 |
| | 50 | EXISTENCE | EXISTENCE | 37.0 |
| | 51 | EXISTENCE | EXISTENCE | 35.2 |

As shown in Table 4, in Examples No. 41 to No. 47 belonging to the range of the present invention, almost no metallic Bi inclusions compounded with MnS were observed. This is because an amount of MnS was reduced extremely. Further, almost no metallic Bi inclusions were also observed. Consequently, it is conceivable that almost all Bi in the non-oriented electrical steel sheet was solid dissolved or segregated in grain boundaries. Furthermore, almost no TiN and TiS also existed in the non-oriented electrical steel sheet. Then, the value of core loss was good.

On the other hand, in Comparative Examples No. 48 to 50, (3) expression was not satisfied, so that metallic Bi inclusions and metallic Bi inclusions compounded with MnS were observed. Further, in Comparative Example No. 51, the S content exceeded the upper limit of the range of the present invention, so that metallic Bi inclusions and metallic Bi inclusions compounded with MnS were observed. Consequently, it is obvious that Bi solid-dissolved in the non-oriented electrical steel sheet or segregated in grain boundaries falls short of 0.0025 mass %. Then, a large number of pieces of TiN and TiS existed in the non-oriented electrical steel sheet, and the value of core loss was significantly large as compared with that in Examples No. 41 to No. 47.

Third Experiment

First, a 50-kg steel containing C: 0.002 mass %, Si: 3.0 mass %, Mn: 0.25 mass %, P: 0.1 mass %, Al: 1.0 mass %, and N: 0.002 mass %, and a balance being composed of Fe and inevitable impurities was melted in a high-frequency vacuum melting apparatus. Thereafter, a 20-g metallic Bi was directly added to the molten steel while the temperature of the molten steel was maintained at 1600° C., and the molten steel was sampled every after a time shown in Table 5, and the Bi content was examined by a chemical analysis. A result thereof is shown in Table 5 and FIG. 4.

TABLE 5

| ELAPSED TIME (MINUTE) | Bi CONTENT (MASS %) | YIELD OF Bi (%) |
|---|---|---|
| 0.2 | 0.036 | 90 |
| 0.5 | 0.0312 | 78 |
| 1 | 0.0248 | 62 |
| 2 | 0.0136 | 34 |
| 3 | 0.0032 | 8 |
| 4 | LESS THAN 0.0001 | — |
| 5 | LESS THAN 0.0001 | — |
| 7 | LESS THAN 0.0001 | — |
| 10 | LESS THAN 0.0001 | — |

Figure 4:
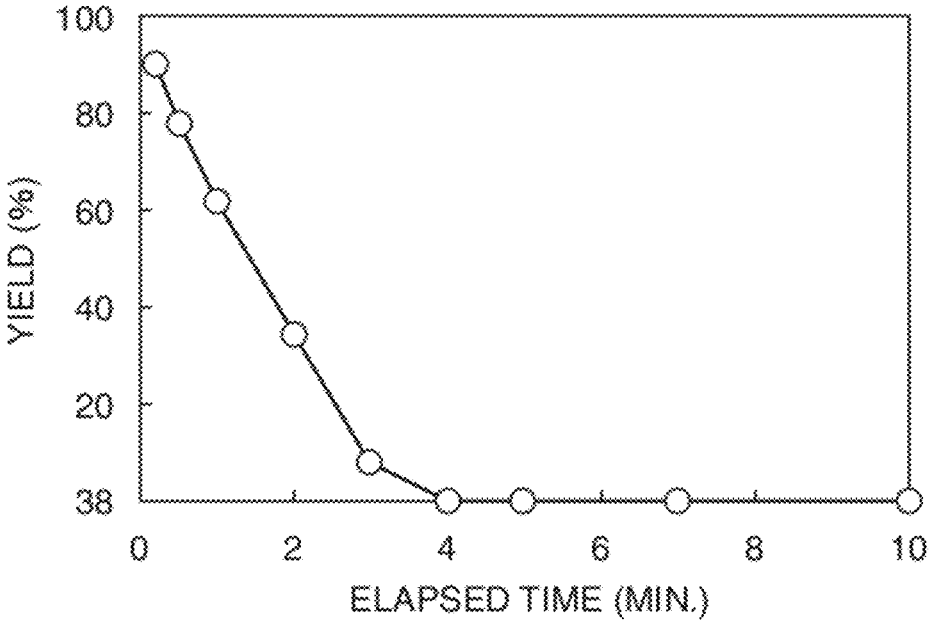
FIG. 4 is a view showing a change in the Bi content.

As shown in Table 5 and FIG. 4, after the addition of Bi, the Bi content in the molten steel was rapidly reduced with the elapsed time. When three minutes elapsed since the addition of Bi, almost no Bi in the molten steel remained. Consequently, from Third Experiment, it became obvious that Bi is preferably added to the molten steel within three minutes before the molten steel starts to solidify.

INDUSTRIAL APPLICABILITY

The present invention can be utilized in, for example, an industry of manufacturing electrical steel sheets and an industry in which electrical steel sheets are used.

The invention claimed is:

1. A manufacturing method of a non-oriented electrical steel sheet, comprising:

producing molten steel consisting essentially of:

Si: not less than 1.0 mass % nor more than 3.5 mass %;

Al: not less than 0.1 mass % nor more than 3.0 mass %;

Mn: not less than 0.1 mass % nor more than 2.0 mass %/o; and

Ti: not less than 0.001 mass % nor more than 0.01 mass %, a C content being 0.01 mass % or less, a P content being 0.1 mass % or less, a N content being 0.005 mass % or less, a S content being 0.005 mass % or less, and a balance comprising Fe and inevitable impurities;

adding Bi to the molten steel such that a Bi content in the non-oriented electrical steel sheet becomes not less than 0.001 mass % nor more than 0.01 mass %, and (1) expression described below is satisfied when a Ti content (mass %) is represented as [Ti] and the Bi content (mass %) is represented as [Bi]; and pouring the molten steel into a mold and solidifying the molten steel after adding the Bi, wherein adding the Bi comprises supplying a wire-shaped metallic Bi covered with Fe into the molten steel in the vicinity of a pouring port of a tundish into the mold within three minutes before the molten steel starts to solidify, $$[Ti] \leq 0.8 \times [Bi] + 0.002 \quad (1).$$

2. The manufacturing method of a non-oriented electrical steel sheet, according to claim 1, wherein, in said adding Bi, an added amount of Bi is adjusted such that (2) expression described below is further satisfied $$[Ti] \leq 0.65 \times [Bi] + 0.0015 \quad (2).$$

3. The manufacturing method of a non-oriented electrical steel sheet according to claim 1, wherein the molten steel further contains at least one member selected from the group consisting of Cu: 0.5 mass % or less and Cr: 20 mass % or less.

4. The manufacturing method of a non-oriented electrical steel sheet according to claim 1, wherein the molten steel further contains at least one member selected from the group consisting of Sn and Sb being 0.3 mass % or less in total.

5. The manufacturing method of a non-oriented electrical steel sheet according to claim 1, wherein the molten steel further contains Ni: 1.0 mass % or less.

6. A manufacturing method of a non-oriented electrical steel sheet, comprising:

producing molten steel consisting essentially of:

Si: not less than 1.0 mass % nor more than 3.5 mass %;

Al: not less than 0.1 mass % nor more than 3.0 mass %;

Mn: not less than 0.1 mass % nor more than 2.0 mass %;

Ti: not less than 0.001 mass % nor more than 0.01 mass %; and at least one member selected from the group consisting of REM and Ca, a C content being 0.01 mass % or less, a P content being 0.1 mass % or less, a N content being 0.005 mass % or less, a S content being 0.01 mass % or less, and a balance comprising Fe and inevitable impurities, adding Bi to the molten steel such that a Bi content in the non-oriented electrical steel sheet becomes not less than 0.001 mass % nor more than 0.01 mass %, and (1) expression described below is satisfied when a Ti content (mass %) is represented as [Ti] and the Bi content (mass %) is represented as [Bi]; and pouring the molten steel into a mold and solidifying the molten steel after adding the Bi, wherein when the S content (mass %) in the molten steel is represented as [S], a REM content (mass %) in the molten steel is represented as [REM], and a Ca content (mass %) in the molten steel is represented as [Ca], (3) expression described below is satisfied, and wherein adding the Bi comprises supplying a wire-shaped metallic Bi covered with Fe into the molten steel in the vicinity of a pouring port of a tundish into the mold within three minutes before the molten steel starts to solidify, $$[Ti] \leq 0.8 \times [Bi] + 0.002 \quad (1),$$

$$[S] - (0.23 \times [REM] + 0.4 \times [Ca]) \leq 0.005 \quad (3).$$

7. The manufacturing method of a non-oriented electrical steel sheet according to claim 1, wherein the molten steel further contains at least one member selected from the group consisting of Cu: 0.5 mass % or less and Cr: 20 mass % or less.

8. The manufacturing method of a non-oriented electrical steel sheet according to claim 6, wherein the molten steel further contains at least one member selected from the group consisting of Sn and Sb being 0.3 mass % or less in total.

9. The manufacturing method of a non-oriented electrical steel sheet according to claim 6, wherein the molten steel further contains Ni: 1.0 mass % or less.

* * * * *